United States Patent [19]

Seymour et al.

[11] Patent Number: 4,484,045

[45] Date of Patent: Nov. 20, 1984

[54] MOLDED CASE CIRCUIT BREAKER HAVING IMPROVED ARC RESISTANT PROPERTIES

[75] Inventors: Raymond K. Seymour, Plainville; William J. Ashline, Bristol, both of Conn.

[73] Assignee: General Electric Company, New York, N.Y.

[21] Appl. No.: 408,375

[22] Filed: Aug. 16, 1982

[51] Int. Cl.[3] ..... H01H 33/04; H01H 9/30

[52] U.S. Cl. ..... 200/144 R; 200/147 R

[58] Field of Search ..... 200/144 R, 147 R

[56] References Cited

U.S. PATENT DOCUMENTS

| | | | |
|---|---|---|---|
| 3,270,170 | 8/1966 | Fehrenbach et al. | 200/144 R |
| 3,506,799 | 4/1970 | Ellsworth et al. | 200/144 R |
| 3,564,176 | 2/1971 | Fechant | 200/144 R |
| 4,011,420 | 3/1977 | Heft | 200/147 R |

*Primary Examiner*—Robert S. Macon

*Attorney, Agent, or Firm*—Richard A. Menelly; Walter C. Bernkopf; Fred Jacob

[57] ABSTRACT

Molded case circuit breakers having increased short circuit current ratings contain a dual contact blade arm assembly and an arc shield wherein the operating mechanism is shielded from the arc blast which occurs during contact arcing. The arc blast shield consists of a trifurcated barrier interposed between the circuit breaker operating mechanism and the arc chute without interfering with the contact arm motion.

9 Claims, 5 Drawing Figures

PRIOR ART

MOLDED CASE CIRCUIT BREAKER HAVING IMPROVED ARC RESISTANT PROPERTIES

BACKGROUND OF THE INVENTION

Molded case circuit breakers are currently available for operating over a wide range of currents. Over such a wide range of operating currents, the circuit breaker operating mechanism design remains somewhat unchanged, while the current carrying components must be increased to be able to handle the increased ampacity. One of the most rigid tests that must be performed before a breaker acquires the requisite approvals, is a short circuit withstand test, wherein the breaker is subjected to a short circuit current up to several hundred times the current that the breaker is rated for under steady state conditions. It has become more difficult to increase the size of the breaker components without increasing the size of the breaker case dimensions.

One of the factors causing breaker failure under short circuit test conditions is damage from the arc blast which occurs during contact arcing. The blast extends from the arc chamber to completely engulf the breaker operating mechanism. The high temperatures existing within the gases evolved during arcing severely affect the temper of the operating spring as well as degrading the properties of the contact arm and the latch assembly. At very high short circuit current conditions, exposure of the operating mechanism to the intense arc blast can eventually cause the operating mechanism to fail.

Several earlier attempts were made to protect the operating mechanism from the arc blast which occurs during contact arcing.

U.S. patent application Ser. No. 353,449 filed Mar. 1, 1982, describes a thermal shield for protecting the operating spring during contact arcing conditions.

U.S. Pat. No. 4,011,420 entitled "Molded Case Circuit Breaker With Improved Interrupting Capacity" describes a shield which is formed by projections extending from the circuit breaker cover and base assembly.

U.S. Pat. Nos. 3,268,689 and 3,287,522 describe circuit breaker contact assemblies having dual parallel blade contact arms wherein the contact arm and flexible conductor are able to withstand a number of mechanical operations without damage.

One method of protecting the circuit breaker operating mechanism from the arc blast consisted of a movable arc shield which was attached at one end to the movable contact arm. The function of the movable arc shield was to protect the contact operating spring from the arc blast during contact arcing. The arc shield of the instant invention improves over the movable arc shield of the prior art since the movable arc shield could become separated from the contact arm and become inoperative.

The purpose of this invention is to provide a unique arc shield arrangement, when used in combination with the aformentioned parallel blade contact arm assembly, results in a circuit breaker having substantially improved short circuit current withstand.

SUMMARY OF THE INVENTION

A molded case circuit breaker contains a parallel blade contact arm assembly which is separated from the arcing chamber by means of a trifurcated arc shield. The arc shield serves to contain the arc blast within the arcing chamber and protects the contact mechanism from damage during short circuit test conditions.

DESCRIPTION OF THE PREFERRED EMBODIMENT

Figure 1:
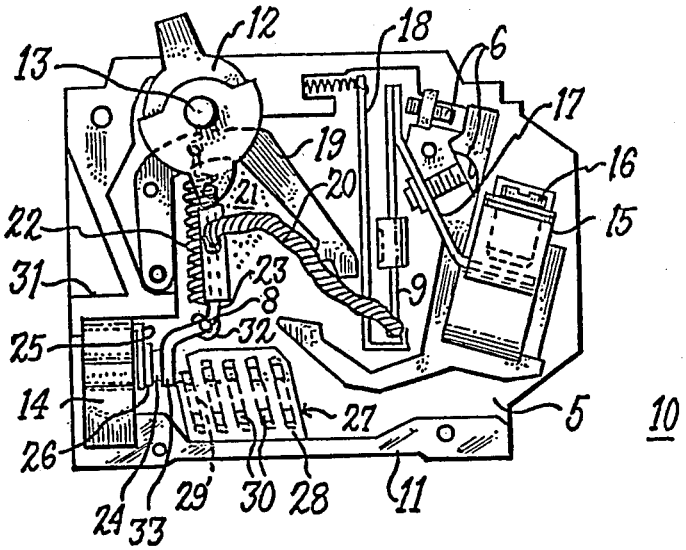
FIG. 1 is a side view of a dual circuit breaker according to the prior art.
Figure 2:
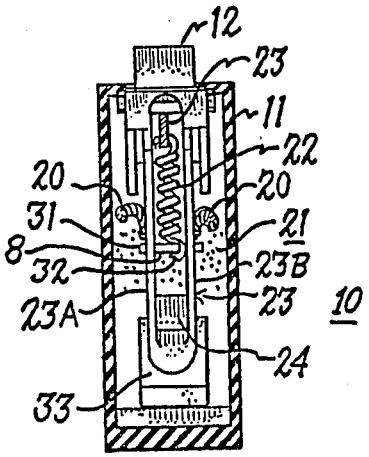
PRIOR ART Fig. 2.
FIG. 2 is an end view, in partial section, of the prior art breaker depicted in FIG. 1.

A circuit breaker 10 containing a dual blade contact arm 23 similar to that disclosed in aformentioned U.S. Pat. No. 3,268,689 having good current carrying capacity is shown within a molded case 11. The circuit breaker is of the type having an operational handle 12 assembled within the case by means of a pivot 13 and which is connected between a line connection via line terminal 14 and a load connection via load terminal 15. A lug screw 16 holds the load conductor securely within load terminal 15 and conducting strap 17 carries the operational current through bimetal 9 and braids 20 to contact arm 23. Reference can be made to the aformentioned patent for a more detailed description of the interconnection between the circuit breaker operating components. A latch 18 in combination with a cradle mechanism 19 serves to move contact 24 at the end of contact arm 23 out of electrical connection with contact 26 which is connected to fixed contact arm 25. Operating spring 22 is connected between one end of cradle mechanism 19 and a rod 30 extending between the two blades 23A,23B (FIG. 2) of movable contact arm 23. The separation of contacts 24,26 upon the occurrence of a fault condition causes an arc to be drawn to within arc chute 27 (FIG. 1) which is of the type consisting of a pair of insulating sidewalls 28 which support a plurality of parallel arranged arc plates 29 which are attached to the sidewalls by means of studs 8. Upon the occurrence of an arc between separated contacts 24, 26 an arc blast pattern 21 extends from within arc chute 27 to within the region generally shown as a plurality of dots in the vicinity of contact arm 23, operating spring 22, latch 19 and braids 30. The arc blast consists of high temperature gases which are generated between the contacts within the arc chute 27 and can cause oxidation of the metal components comprising spring 22 and latch 19. Circuit breakers designed for example, to perform at 15 to 100 amps steady state rated currents, can withstand short circuit currents up to 10,000 amperes for a period of time sufficient to satisfy most qualifying test requirements with little or no damage to these metal components. When the short circuit current is increased up to 20,000 and 30,000 amps, the metal components of the contact and latch assembly become severely oxidized and damaged. The exposure of the contact and latch assembly which comprises latch arm 21, spring hook 32, rod 30 and spring 22 is shown submersed within the arc blast pattern 21 more clearly in FIG. 2. Contact 24 on contact plate 33 is bulky enough to withstand the short circuit currents and the contact arm blades 23A and 23B are of sufficient ampacity to resist the high temperatures evolved within the arc blast pattern. Spring 22, however, becomes annealed and non-functional. It was discovered that spring 22 by connection with rod 30 and latch arm 21 provides a parallel current path for the high currents evolved during short circuit tests conditions and becomes further heated by resistance heating effects.

Figure 3:
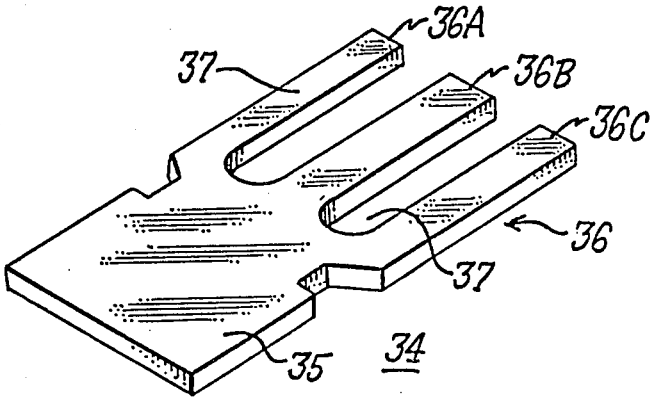
FIG. 3 is a top perspective view of the circuit breaker arc shield according to the invention.

An efficient arc shield 34 fabricated from a nonelectrically conducting material such as a glass melamine or a glass polester resin, and having the same configuration depicted in FIG. 3 is able to protect the operating spring and latch operating mechanism during excessive short circuit current conditions. Some beneficial results are obtained from the ablation that occurs with the shield material contributing to control and extinguish the arc. Another ablative material is a fiber such as a cotton base fiber on the surface of a suitable resin such as a phenolic. The arc shield consists of a base portion 35 containing a trifurcated arm 36 having tnree separate arms 36A–36C with slots 37 intermediate each arm. The purpose of slots 37 is to provide clearance for the two contact blades 23A, 23B, shown earlier in FIG. 2.

Figure 4:
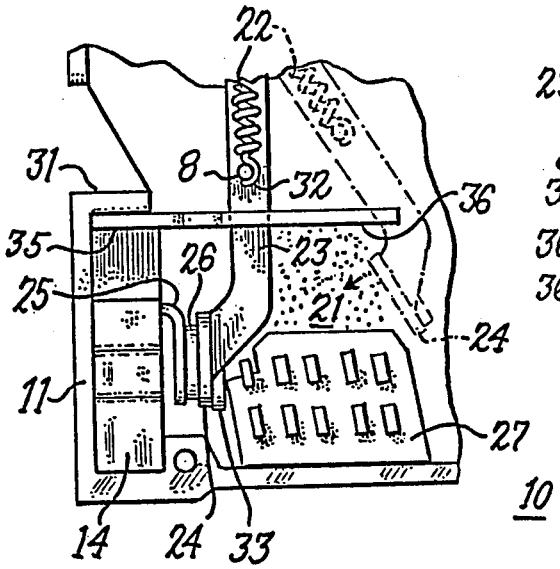
FIG. 4 is a side view of a circuit breaker containing the arc shield depicted in FIG. 3.

Arc shield 34 is shown in FIG. 4 with base 35 assembled between the recess 31 formed in case 11 and the top portion of the fixed contact arm 25. Movable contact 24 and fixed contact 26 operate in the manner described earlier for the prior art breakers shown in FIGS. 1 and 2. Trifurcated arm 36 extends over arc chute 27 and between the arc chute and operating spring 22. The interposition of arc shield 34 between operating spring 22 and the arc chute 27 effectively contains the arc blast 21 between the region existing between arc shield 34 and arc chute 27 as shown in FIG. 4.

Figure 5:
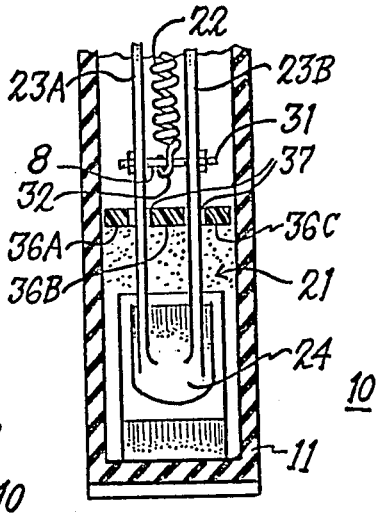
FIG. 5 is an end view in partial section of the circuit breaker depicted in FIG. 4.

FIG. 5 shows contact spring 22 and rod 30 effectively shielded from arc blast 21 by means of the arrangement of arms 36A, 36B and 36C relative to contact arm blades 23A and 23B. The clearance afforded by slots 37 is sufficient to allow for the transport of the contact arms without allowing the gas blast 21 to extend within the region of protected spring 22 and rod 30. In order to eliminate the transport of current through spring 22 under short circuit conditions, rod 30 is made from a non-conducting material and is fastened to the contact arms by a pair of pins 31 in contrast to a single conducting rod which in the prior art, served to retain spring hook 32. The use of a non-metallic rod 30 fabricated from a glass enforced melamine material or polyester effectively insulates spring 22 from the contact arms which carry the excess current during short circuit conditions.

We claim:

1. A circuit breaker having improved short circuit current resistance comprising:

an operating hangle mounted within an insulated case;

a pair of contacts operatively connected with a latching mechanism and a trip mechanism;

a parallel blade contact arm having a contact at one end and carrying an operating spring for separating said contacts upon operation of said trip mechanism;

an arc chute for containing an arc upon separation of said contacts; and an electrically insulating arc shield interposed between said operating spring and said arc chute and retained within said case by means of a recess formed within said case and a top portion of a fixed contact arm for containing said arc within said arc chute.

2. The circuit breaker of claim 1 wherein said arc shield comprises a base portion and at least one arm portion extending from said base portion.

3. The circuit breaker of claim 2 wherein said arm portion is trifurcated to allow for the clearance of said parallel blade contact arm.

4. The circuit breaker of claim 1 wherein said operating spring is retained between a rod extending across said contact blades at one end and an end of said contact arm distal said contact.

5. The circuit breaker of claim 4 wherein said rod is comprised of an electrically insulating material to prevent the transport of electric current through said spring.

6. The circuit breaker of claim 1 wherein said circuit breaker operating spring is positioned between said contact blades.

7. The circuit breaker of claim 1 wherein said arc shield is of an ablative material.

8. The circuit breaker of claim 6 wherein said arc shield is comprised of a glass melamine, a glass polyester resin.

9. The circuit breaker of claim 1 wherein said arc shield is comprised of fiber.

* * * * *